US006115840A

United States Patent [19]

Hastings

[11] Patent Number: 6,115,840

[45] Date of Patent: Sep. 12, 2000

[54] MEDICAL ACCESS SHIRT

[75] Inventor: Warren C. Hastings, 41 Ward St., Athol, Mass. 01331

[73] Assignees: Paul J. Krustapentus; Warren C. Hastings, both of Athol, Mass.

[21] Appl. No.: 09/365,916

[22] Filed: Aug. 3, 1999

[51] Int. Cl.[7] ..... A41B 1/00

[52] U.S. Cl. ..... 2/114; 2/115; 2/913

[58] Field of Search ..... 2/114, 115, 113, 2/111, 83, 80, 104, 106, 69, 70, 77, 105, 109, 118, 119, 127, 913; D2/720, 840

[56] References Cited

U.S. PATENT DOCUMENTS

| | | | |
|---|---|---|---|
| D. 396,339 | 7/1998 | Ramsey . | |
| D. 414,015 | 9/1999 | Small . | |
| 818,351 | 4/1906 | Clark | 2/114 |
| 1,462,515 | 7/1923 | McElroy | 2/114 |
| 2,505,239 | 4/1950 | Goldstein | 2/80 |
| 2,526,785 | 10/1950 | Werber . | |
| 3,911,500 | 10/1975 | Naumovski . | |
| 4,280,228 | 7/1981 | Sulzmann . | |
| 4,382,303 | 5/1983 | Lunt . | |
| 4,566,136 | 1/1986 | Echols . | |
| 4,567,611 | 2/1986 | Kendrick . | |
| 4,644,590 | 2/1987 | Pincham . | |
| 4,665,564 | 5/1987 | Bogart et al. . | |
| 4,920,578 | 5/1990 | Janzen et al. | 2/114 |
| 5,131,096 | 7/1992 | Olson | 2/83 |
| 5,564,123 | 10/1996 | Grassick | 2/114 |
| 5,564,126 | 10/1996 | Chou . | |
| 5,621,917 | 4/1997 | Howsden | 2/111 |
| 5,628,064 | 5/1997 | Chung | 2/119 |
| 5,799,330 | 9/1998 | O'Donoghue-Kitt | 2/114 |

FOREIGN PATENT DOCUMENTS

| | | | |
|---|---|---|---|
| 11480 | of 1895 | United Kingdom | 2/114 |

*Primary Examiner*—Amy B. Vanatta
*Attorney, Agent, or Firm*—Blodgett & Blodgett, P.C.

[57] ABSTRACT

A medical access shirt which includes a lower portion adapted to cover a person's torso, a right sleeve portion and a left sleeve portion connected to the lower portion. The upper part of the shirt includes front, back, right and left flaps. The front and back flaps are integral with the lower portion. Each flap has a top edge and a pair of side edges. Each flap has a top edge and a pair of side edges. The side edges of each of the front and back flaps have first releasable fastening elements for attachably engaging second releasable fastening elements at the side edges of the left and right side flaps so that the upper edges of the flaps form an annular collar and an access opening is formed between each pair of adjoining side edges of the flaps at the lower ends of the flaps.

7 Claims, 4 Drawing Sheets

MEDICAL ACCESS SHIRT

CROSS-REFERENCE TO RELATED APPLICATIONS

NOT APPLICABLE

BACKGROUND OF THE INVENTION

The present invention is related generally to a shirt to be worn for medical purposes and particularly for shirts to be worn by patients who are fitted with a supporting device known as a "halo".

A "halo" is an apparatus which includes a base that is supported on the patient's upper torso and a plurality of posts which extend upwardly from the base and which rigidly support a cranial support and immobilization structure. A "halo" is used for individuals who have had a severe neck injury so that the head must be supported and confined for a period of time to allow for healing of the injured area and to prevent further injury.

Due to the fact that the halo is such a cumbersome and obtrusive structure, it is impossible for the patient to wear normal upper body clothing such as shirts, blouses or sweaters. Since the halo must be worn for an extended period of time, the inability to wear normal apparel represents a serious burden and an inconvenience for the patient.

A number of garments, or shirts have been developed specifically for use with individuals who are equipped with a halo. The shirts are complex constructions which are awkward to apply and to remove. In some cases, the shirt comprises several individual panels or sections which must be assembled and disassembled. These and other difficulties experienced with the prior art, garments for halo patients have been obviated by the present invention.

It is, therefore, a principal object of the invention to provide a shirt for use by a person wearing a halo which can be easily applied and removed by the person.

A further object of the invention is the provision of a "halo" shirt which is simple in construction and has the appearance of normal wearing apparel.

Another object of the invention is the provision of a "halo" shirt which can also be used by a patient for use during some types of medical examinations.

With these and other objects in view, as will be apparent to the those skilled in the art, the invention resides in the combination of parts set forth in the specification and covered by the claims appended hereto.

BRIEF SUMMARY OF THE INVENTION

The invention consists of a medical access shirt which includes a lower portion adapted to cover a person's torso, a right sleeve portion and a left sleeve portion connected to the lower portion. The upper part of the shirt includes front, back right and left flaps. The front and back flaps are integral with the lower portion of the shirt. The right and left slaps are integral with the right and left sleeve portions, respectively. Each flap has a top edge and a pair of side edges. The side edges of each of the front and back flaps have first releasable fastening elements for attachably engaging second releasable fastening elements at the side edges of the left and right side flaps so that the upper edges of the flaps form an annular collar and an access opening is formed between each pair of adjoining side edges of the flaps.

BRIEF DESCRIPTION OF THE DRAWINGS

The character of the invention, however, may be best understood by reference to one of its structural forms, as illustrated by the accompanying drawings in which.

DETAILED DESCRIPTION OF THE INVENTION

Figure 1:
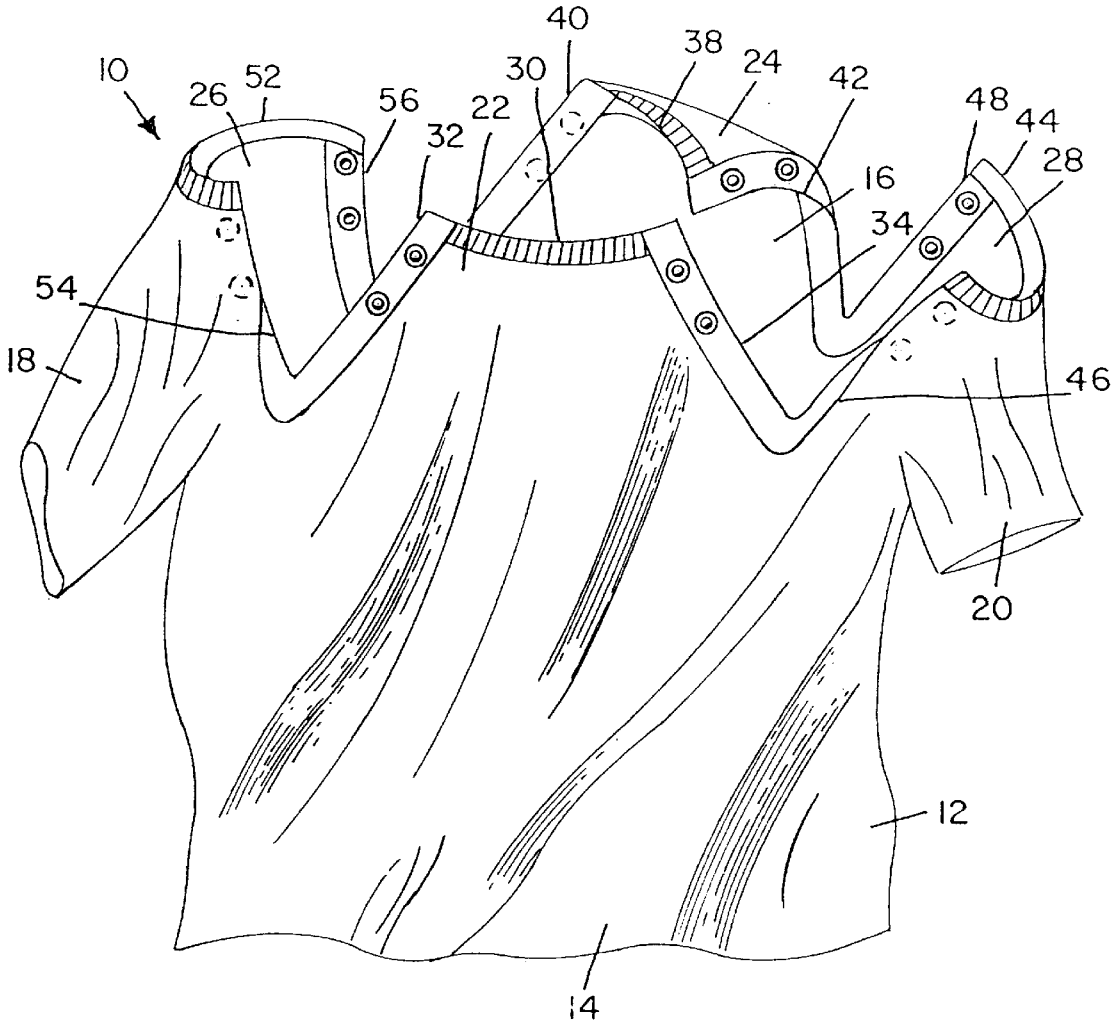
FIG. 1 is a front elevational view of a shirt embodying the principles of the present invention.

Referring first to FIG. 1, there is illustrated a medical access shirt embodying the principles of the present invention generally indicated by the reference numeral 10. Shirt 10 has a front side 14 and a back side 16. Shirt 10 comprises a lower tubular portion 12 adapted to encircle the torso of a person, a right sleeve portion 18 and a left sleeve portion 20. A front flap 22 and a back flap 24 are integrally connected to the lower portion 12. A right flap 26 is integrally connected to the right sleeve 18. A left flap 28 is integrally connected to the left sleeve 20.

The front flap 22 has a top edge 30, a pair of opposite side edges 32 and 34. The back flap 24 has a top edge 38 and opposite side edges 40 and 42. First releasable fastening elements in the form of snap fasteners 36 are located adjacent each of the side edges 32, 34, 40 and 42.

The right flap 26 has a top edge 52 and a pair of opposite side edges 54 and 56. The left flap 28 has a top edge 44 and a pair of opposite side edges 46 and 48. Second releasable fastening elements, in the form of snap fasteners 50, are located adjacent each of the side edges 46, 48, 54 and 56. The snap fasteners 50 are complementary to the snap fasteners 36. In the example shown in FIG. 1, the snap fasteners 36 are the male components while the snap fasteners 50 are the female components. However, the employment of the snap fasteners 36 and 50 can be reversed from the arrangement of snap fasteners illustrated in FIG. 1.

Figure 2:
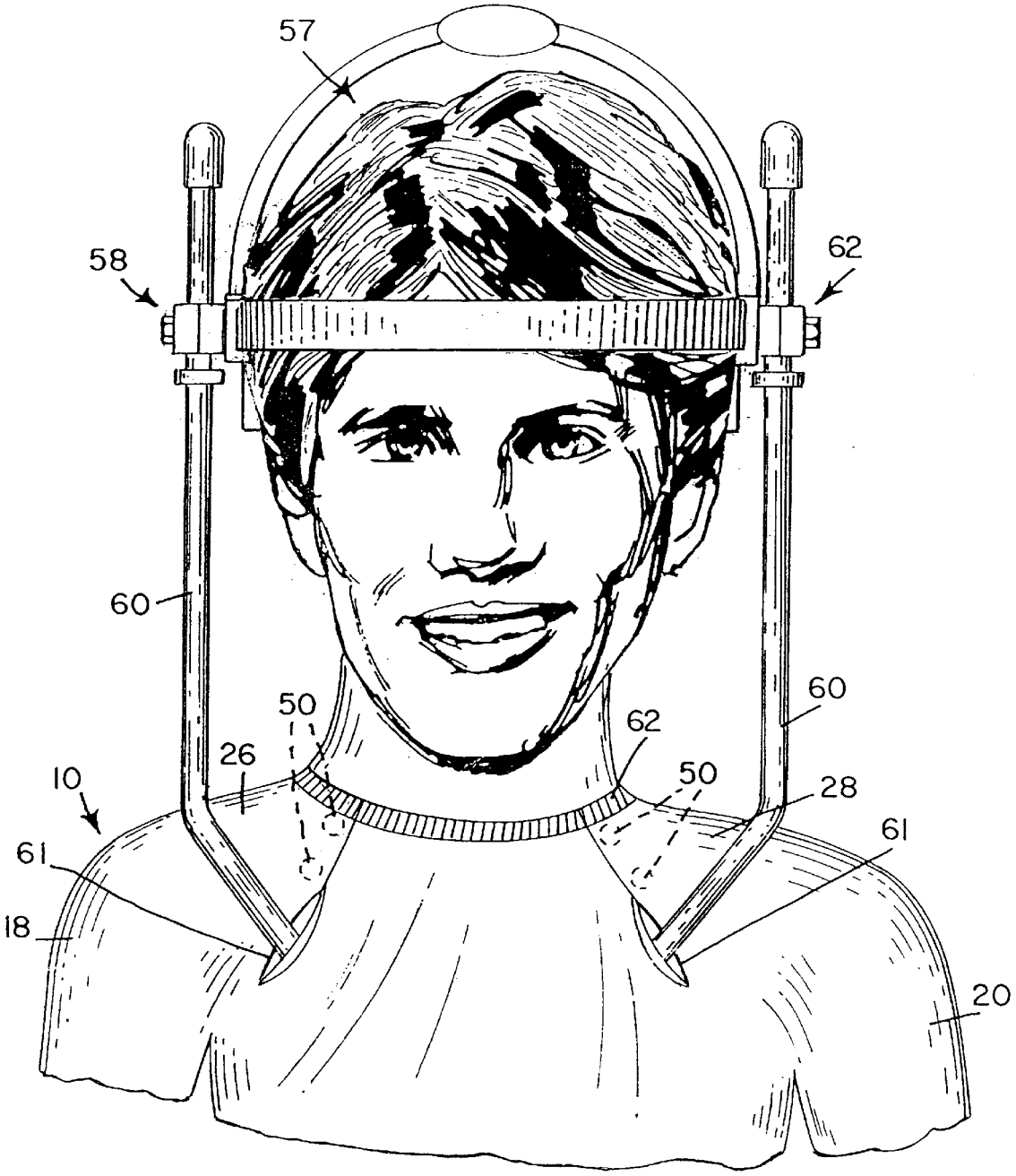
FIG. 2 is a front elevational view of the shirt of FIG. 1 shown applied to a person who has been fitted with a halo, with portions of the shirt broken away.

Referring to FIG. 2, the shirt 10 is shown applied to a person, generally indicated by the reference numeral 57, who is fitted with a halo device, generally indicated by the reference numeral 58. The halo 58 comprises a base portion (not shown) supported on the person's chest. A plurality of posts 60 extending upwardly from the base portion and supporting a cranial support and immobilization structure, generally indicated by the reference numeral 62. The halo 58 has four posts, two posts in front and two posts in the back. The shirt 10 is applied to the person 57 fitted with the halo 58 by slipping the bottom of the shirt over the structure 62 and post 60 with the flaps 22, 24, 26 and 28 in the open, or unfastened condition as shown in FIG. 1. When the upper portion of the shirt 10 is at the person's shoulders, the right and left flaps 26 and 28, respectively, are connected to both of the front and rear flaps 22 and 24, respectively, by forcing the snap fastener elements 36 into the snap fastener elements 50. When the right and left flaps have been connected to the front and rear flaps, the top edges 30, 38, 52 and 44 form a continuous collar 63 around the person's neck as shown in FIG. 2. When all the fastening elements have been connected, an access opening 61 is formed at the lower end of the juncture of each side edge of the side flaps 26 and 28 with the side edges of the front and rear flaps 22 and 24, respectively. The post 60 extends upwardly through the access opening 61.

Figure 3:
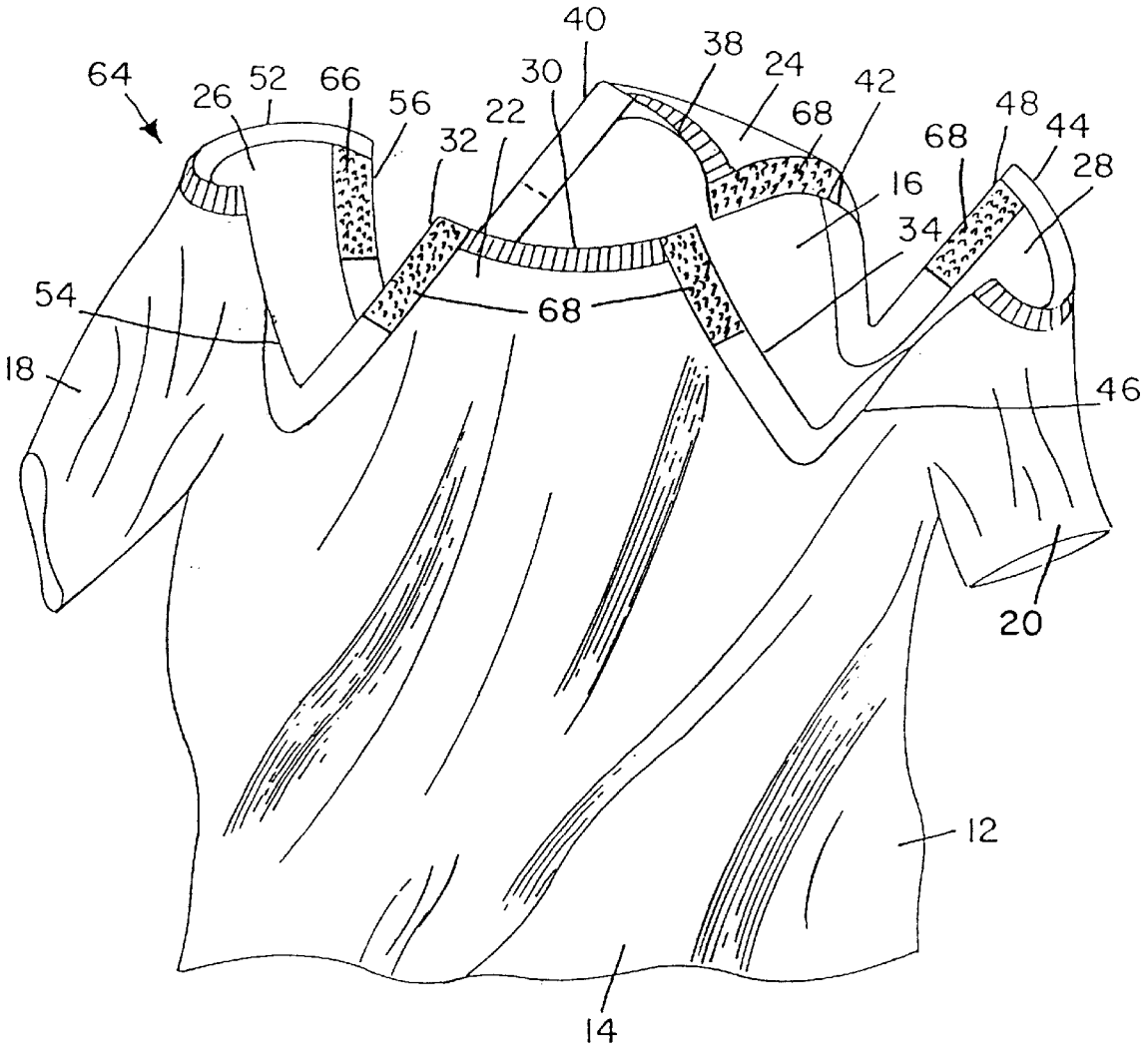
FIG. 3 is a front elevational view of the shirt of FIG. 1 showing a first modified fastening means.

Referring to FIG. 3, there is illustrated a medical access short, generally indicted by the reference numeral 64. Shirt

64 is identical to the shirt 10 shown in FIG. 1 except that the releasable fastening elements are strips of hook and loop fasteners. In the example shown in FIG. 3, strips bearing the loops are indicated by the reference numeral 66 and are shown in FIG. 3 as being attached to the side flaps 26 and 28. The strips bearing the hooks are indicated by the reference numeral 68 and are shown applied to the front and rear flaps 22 and 24, respectively.

Figure 4:
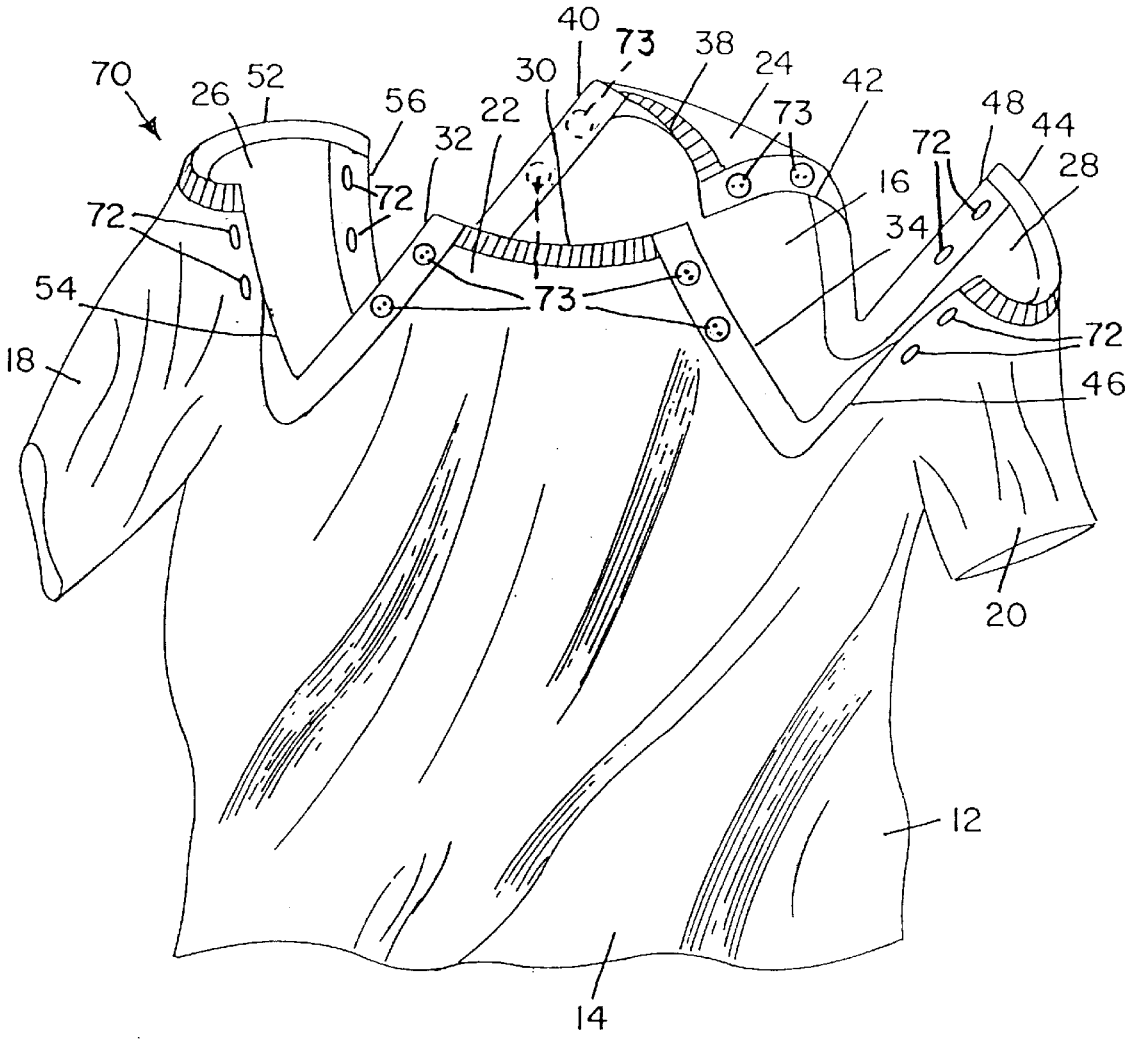
FIG. 4 is a front elevational view of the shirt of FIG. 1 showing a first modified fastening means.

Referring to FIG. 4, there is illustrated a medical access shirt, generally indicated by the reference numeral 70, which is identical to shirt 10 except that the releasable fastening elements are buttons and button holes. The button holes are indicated by the reference numeral 72 and they are shown adjacent the side edges of the right and left flaps 26 and 28, respectively. The buttons are indicated by the reference numerals 73 and they are shown fixed along the side edges of the front and rear flaps 22 and 24, respectively. If desired, zippers could also be employed for releasably fastening the side flaps 26 and 28 to the front and rear flaps 22 and 24, respectively. The zippers would be effective for only the upper portions of the flaps. The access opening for each post 60 would be located below each zipper.

Although the medical access shirt of the present invention is primarily adapted for use with a person wearing a halo, the shirt can also be worn by patients for certain types of medical examinations involving the upper torso.

What is claimed is:

1. A medical access shirt comprising:

(a) a lower encircling portion having a front side and a back side for covering the torso of a person, each of said front side and said back side having an upper end;

(b) a right sleeve portion integral with said lower encircling portion and having an upper end;

(c) a left sleeve portion integral with said lower encircling portion and having an upper end;

(d) a front flap at the upper end of said front side and integral with said lower encircling portion, said front flap having a top edge and a pair of opposite side edges;

(e) a back flap at the upper end of said back side and integral with said lower encircling portion, said back flap having a top edge and a pair of opposite side edges;

(f) a right flap at the upper end of said right sleeve and integral with said right sleeve, said right flap having a top edge and a pair of opposite side edges;

(g) a left flap at the upper end of said left sleeve and integral with said left sleeve, said left flap having a top edge and a pair of opposite side edges;

(h) first releasable fastening elements adjacent each side edge of each of said front and back flaps; and (i) second releasable fastening elements adjacent each side edge of each of said left and right flaps which are complementary with said first releasable fastening elements so that when the first releasable fastening elements of each of said front and back flaps are fastened to the second releasable fastening elements of said left and right sleeves which are adjacent said first releasable fastening elements, the top edges of said right, left, front and back flaps define an annular collar.

2. A medical access shirt as recited in claim 1, wherein said first and second releasable fastening elements are disposed on said front, back, left and right flaps so that when said first releasable fastening elements are fastened to said second releasable fastening elements, an access opening is formed between the side edges of each of said front and rear flaps and adjacent the side edges of each of said left and right flaps.

3. A medical access shirt as recited in claim 2, wherein said access openings are adjacent lower ends of said flaps.

4. A medical access shirt as recited in claim 1, wherein said first and second fastening elements are snap fasteners.

5. A medical access shirt as recited in claim 1, wherein each of one of said first and second releasable fastening elements is a button and each of the other of said first and second fastening elements is a button hole.

6. A medical access shirt as recited in claim 1, wherein said first and second releasable fastening elements are hook and loop fasteners.

7. A medical access shirt as recited in claim 1, wherein each one of said first and second releasable fastening elements faces outwardly and each of the other of said first and second releasable fastening elements faces inwardly so that the side edges of said flaps which contain the inwardly facing releasable fastening elements overlap the side edges of said flaps which contain the outwardly facing releasable fastening elements.

* * * * *